US007696962B2

(12) United States Patent
Hara et al.

(10) Patent No.: US 7,696,962 B2
(45) Date of Patent: Apr. 13, 2010

(54) COLOR BALANCING CIRCUIT FOR A DISPLAY PANEL

(75) Inventors: Tetsuro Hara, Tokyo (JP); Naoya Kimura, Chiba (JP); Takayuki Shimizu, Tokyo (JP); Akira Kondo, Fukuoka (JP); Haruyo Takayanagi, Chiba (JP); Shinichi Satoh, Tokyo (JP)

(73) Assignee: Oki Semiconductor Co., Ltd. (JP)

( * ) Notice: Subject to any disclaimer, the term of this patent is extended or adjusted under 35 U.S.C. 154(b) by 958 days.

(21) Appl. No.: 11/127,086

(22) Filed: May 12, 2005

(65) Prior Publication Data

US 2006/0023002 A1 Feb. 2, 2006

(30) Foreign Application Priority Data

Aug. 2, 2004 (JP) ..... 2004-226105

(51) Int. Cl.
*G09G 5/10* (2006.01)

(52) U.S. Cl. ..... 345/77; 345/690

(58) Field of Classification Search ..... 345/76–77, 345/82–83, 690
See application file for complete search history.

(56) References Cited

U.S. PATENT DOCUMENTS

| | | | | |
|---|---|---|---|---|
| 5,325,153 | A * | 6/1994 | Mitsuse et al. | 399/74 |
| 7,304,655 | B2 * | 12/2007 | Choi et al. | 345/690 |
| 2004/0155840 | A1 * | 8/2004 | Abe et al. | 345/76 |
| 2005/0029968 | A1 * | 2/2005 | Shimoda | 315/293 |
| 2005/0062691 | A1 * | 3/2005 | Tamura et al. | 345/76 |

FOREIGN PATENT DOCUMENTS

| | | | |
|---|---|---|---|
| JP | 7-129100 | | 5/1995 |
| JP | 8-286636 | | 11/1996 |
| JP | 2000-047639 | | 2/2000 |
| JP | 2001-42823 | | 2/2001 |
| JP | 2001-134255 | | 5/2001 |
| JP | 2004-004801 | | 1/2004 |
| JP | 2004004801 | A * | 1/2004 |
| JP | 2004-094237 | | 3/2004 |
| WO | 2004-040542 | A1 | 5/2004 |

OTHER PUBLICATIONS

Office Action issued on Aug. 24, 2007 in connection with counterpart Japanese Application No. 2004-226105 (Partial Translation).
Office Action issued on Jan. 25, 2008 in connection with counterpart Chinese Patent Application No. 200510054435.5 (No Translation).

* cited by examiner

*Primary Examiner*—Amr Awad
*Assistant Examiner*—Tony Davis
(74) *Attorney, Agent, or Firm*—Studebaker & Brackett PC; Donald R. Studebaker

(57) ABSTRACT

A color balancing circuit for a flat panel display such as an electroluminescent display generates a primary current that can be varied to adjust the overall brightness of the display. Three currents related to the primary current by selectable ratios are generated, by current mirror circuits, for example; the ratios can be individually varied to adjust the color balance. Driving currents are generated from the three adjusted currents, by mirroring the adjusted currents, for example, and are used to drive display elements that emit light in the three primary colors. Image brightness and color balance can accordingly be adjusted separately, even though both are adjusted by adjusting the driving current. Circuit size is reduced in that the same primary current is used for all three primary colors.

20 Claims, 7 Drawing Sheets

COLOR BALANCING CIRCUIT FOR A DISPLAY PANEL

BACKGROUND OF THE INVENTION

1. Field of the Invention

The present invention relates to a color balancing circuit for use in a flat color display panel such as an electroluminescence (EL) panel employing organic EL elements.

2. Description of the Related Art

Organic EL panels are also known as organic light-emitting diode (OLED) panels. Other known types of flat panel displays include liquid crystal display (LCD) panels, non-organic light-emitting diode (LED) panels, and plasma display panels (PDPs). Two desirable qualities of these displays are an adjustable overall brightness and an adjustable balance of the brightness of the three primary colors red, green, and blue, so that colors can be accurately reproduced.

Japanese Patent Application Publication No. 2001-42823 discusses the driving of an organic EL multicolor display panel having a passive matrix structure. The panel has red, green, and blue electroluminescent elements (EL elements) disposed at the intersections of a plurality of column electrodes (also referred to as anode lines or drive lines) with a plurality of row electrodes (also referred to as cathode lines or scanning lines). When a direct-current (DC) driving voltage exceeding the emission threshold of an EL element is applied to the EL element, it emits light with a brightness proportional to the current that flows from the column line to the row line in response to the applied voltage. If the applied voltage is less than the emission threshold voltage, no current flows and the emission brightness remains zero.

The red, green, and blue EL elements are arranged so that all the EL elements in the same column are of the same color. A first potential and a higher second potential are selectively supplied to the row electrodes. A third potential that provides an offset voltage below the emission threshold voltage of the EL elements and a current source that provides driving current are selectively connected to the column electrodes. The driving current and the third potential are variable and can be adjusted to different values for the red, blue, and green columns, to equalize the voltage changes in the different columns, thereby improving the light emission rise characteristic. This arrangement permits adjustment of both overall brightness and color balance, but separate adjustment circuitry is required for each of the three primary colors.

Japanese Patent Application Publication No. 2001-134255 discusses the automatic adjustment of brightness according to the user's needs and ambient conditions (surrounding brightness) in a flat display panel such as an LCD panel with an adjustable backlight. The flat display panel has a display screen and a sensor disposed near the display screen for sensing surrounding brightness. An automatic (primary) adjustment of the brightness of the display screen is performed according to a signal output from the sensor. The flat display panel also has means by which the user can set the brightness of the display screen, means for setting the brightness characteristic of the display screen according to the ambient brightness detected by the sensor and the brightness value set by the user, and means for automatically adjusting the brightness of the display screen, after it has been set by the user, according to the brightness characteristic and the signal output from the sensor. This scheme provides a convenient brightness adjustment, but color balance must be adjusted by completely separate means.

Japanese Patent Application Publication No. 07-129100 discusses a simplified adjustment of the brightness of a color LED lamp panel. The lamp panel module has a plurality of picture elements (pixels), each comprising red, green, and blue LEDs that can combine to display an arbitrary color. The lamp panel module includes respective dimmer circuits in the red, green, and blue LED control circuits for independently controlling and adjusting the brightness of the red, green, and blue light, and has means for frequency control of the dimmer circuits. Color balance can thereby be adjusted, but this system fails to provide a single convenient adjustment for overall image brightness.

Japanese Patent Application Publication No. 08-286636 discusses the adjustment of the brightness of a plasma display panel. The mechanism by which a plasma display panel emits light is electrical discharge in a gas. Different pixel intensities are obtained by controlling the number of discharges on a pixel-by-pixel basis according to pixel data. Brightness is adjusted by doubling, tripling, or quadrupling the number of discharges, and also by multiplying the pixel data by a continuously variable gain factor. This scheme provides a continuous brightness adjustment over a wide range, but does not provide for adjustment of color balance.

In an organic EL panel, color balance and overall brightness can both be adjusted by adjusting the driving current supplied to the red, green, and blue light-emitting elements. If a separate adjustment is made for each primary color, an arbitrary desired color balance can be obtained, but separate adjustment circuitry is required for each color and overall brightness adjustment is inconvenient, because three separate adjustments are necessary. If a single adjustment of the driving current for all three primary colors is made, however, then although brightness adjustment is convenient and the amount of adjustment circuitry can be reduced, the color balance cannot be adjusted to suit the user's preferences, or to compensate for fabrication variations or aging changes.

For use in a flat color display panel such as an organic EL panel, it would be desirable to have a color balancing circuit capable both of adjusting the red, green, and blue driving currents individually to obtain a desired color balance, and of adjusting all three of the driving currents together to obtain a desired display brightness.

SUMMARY OF THE INVENTION

An object of the present invention is to provide a color balancing circuit that efficiently combines brightness adjustment with color balancing.

The invented color balancing circuit has a reference voltage generator for generating a reference voltage. A primary adjustment block varies the reference voltage according to a brightness adjustment signal having a user-selectable value, and converts the varied reference voltage to a primary current. A red adjustment block generates a red adjusted current related to the primary current by a ratio selected according to a red adjustment signal having another user-selectable value; a green adjustment block generates a green adjusted current related to the primary current by a ratio selected according to a green adjustment signal having yet another user-selectable value; a blue adjustment block generates a blue adjusted current related to the primary current by a ratio selected according to a blue adjustment signal having still another user-selectable value. Three drivers then generate red, green, and blue driving currents from the red, green, and blue adjusted currents, and three output stages generate output currents from the red, green, and blue driving currents and supply the output currents to the red, green, and blue light-emitting elements, causing the red, green, and blue light-emitting elements to emit light.

The red, green, and blue adjustment blocks may comprise respective current mirror circuits for mirroring the primary current with separately adjustable current ratios. The drivers and output stages may also comprise current mirror circuits.

The overall display brightness can by adjusted by a single adjustment of the primary current. The color balance can then be adjusted by separate ratio adjustments in the red, green, and blue adjustment blocks. The total amount of adjustment circuitry required for the brightness and color balance adjustments is reduced because both adjustments use the same primary current.

DETAILED DESCRIPTION OF THE INVENTION

Figure 1:
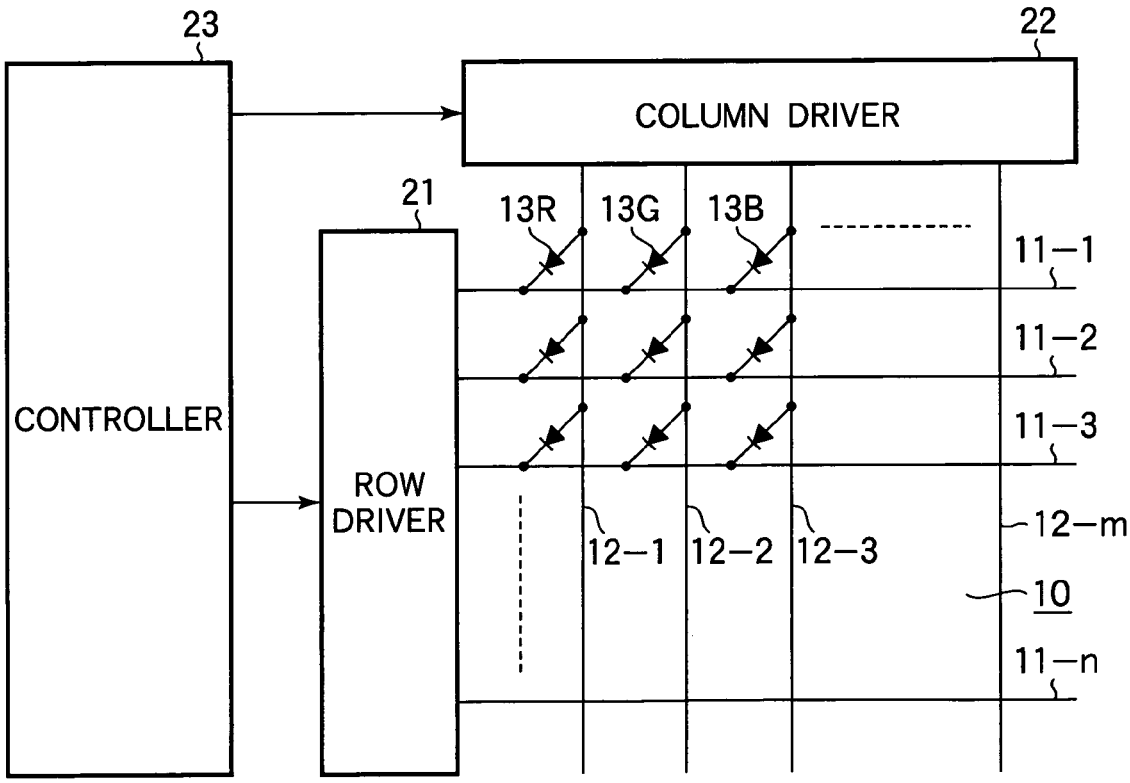
FIG. 1 is a block diagram illustrating the general structure of an organic EL panel.

Embodiments of the invention will now be described with reference to the attached drawings, in which like elements are indicated by like reference characters.

The embodiments are color balancing circuits incorporated into a display panel having a matrix of picture elements such as red, blue, and green organic EL elements. In each embodiment, the color balancing circuit has a reference voltage generator, a primary adjustment block, and red, green, and blue adjustment blocks followed by respective drivers and output stages.

The primary adjustment block includes a voltage divider that divides the reference voltage to obtain a plurality of divided voltages, a selector that selects one of the divided voltages according to a brightness adjustment signal, and a converter circuit that uses a first operational amplifier (hereinafter, op-amp), a transistor, and a resistor to convert the selected divided voltage to a primary current.

Each of the red, green, and blue adjustment blocks includes a plurality of transistors and a like plurality of switching elements coupled to function as a first current mirror circuit generating an adjusted current related to the primary current by a selectable ratio.

Each driver includes a second current mirror circuit and a second op-amp that cooperate to generate a driving current equal to the adjusted current and a control voltage that can be used to mirror the driving current.

Each output stage includes further transistors connected to the driver in a third current mirror configuration to generate output currents that mirror the driving current.

First Embodiment

The first embodiment is employed in a display panel such as a passive matrix organic EL panel having the structure shown schematically in FIG. 1. This organic EL panel has a panel surface 10 for display of an image. A plurality of row electrodes 11-1 to **11-*n* extend in the row direction and a plurality of column electrodes 12-1 to 12-*m* extend in the column direction on the panel surface 10, where m and n are arbitrary positive integers, m being divisible by three. EL elements 13R that emit red light, EL elements 13G that emit green light, and EL elements 13B that emit blue light are disposed at the intersections of the row and column electrodes to form an n×m matrix. A triplet of EL elements 13R, 13G, and 13**B constitutes a single picture element or pixel. The display surface includes a large number of these pixels.

A row driver 21 is connected to the row electrodes 11-1 to **11-*n*; a column driver 22 is connected to the column electrodes 12-1 to 12-*m*. The row driver 21 has a plurality of switching elements for switching each of the row electrodes 11-1 to 11-*n* between the ground potential GND and the power supply potential VCC, for example. The plurality of row electrodes 11-1 to 11-*n* are switched from the power supply potential VCC to the ground potential GND one by one and thereby scanned. The column driver 22 has an output stage with a plurality of transistors. When a row electrode is scanned (when row electrode 11-1 is connected to the ground potential GND, for example), the column driver 22 supplies red, green, and blue output currents to the column electrodes (12-1, 12-2, and 12-3, for example), to which the EL elements (13R, 13G, and 13**B) constituting the pixel that is to emit light are connected.

A controller 23 controls the row driver 21 and the column driver 22. The controller 23 outputs control signals to the switching elements in the row driver 21 according to image data and a clock signal, and supplies output currents through transistors in the output stage of the column driver 22.

Figure 2:
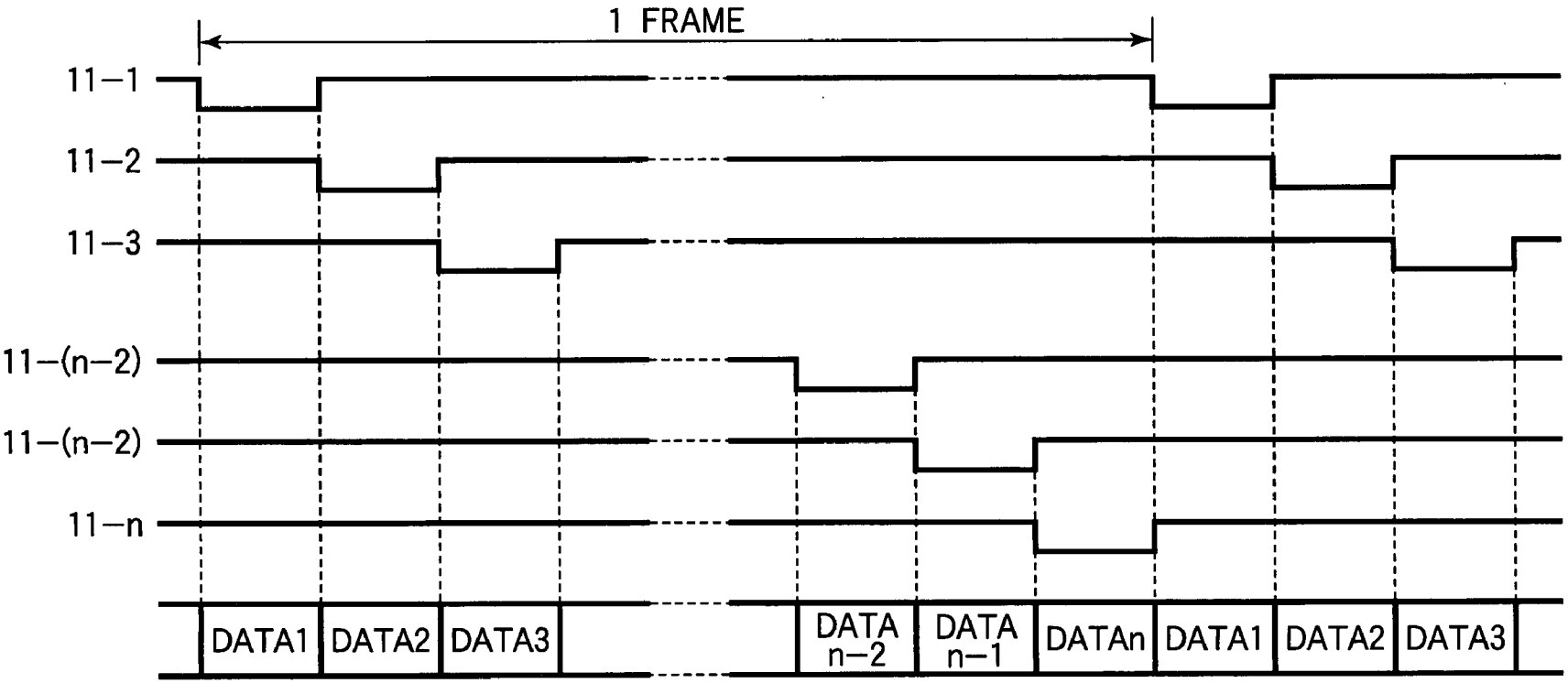
FIG. 2 is a timing diagram illustrating the operation of the EL panel in FIG. 1.

FIG. 2 is a timing diagram illustrating the operation of the EL panel in FIG. 1.

As the row driver 21 scans the plurality of row electrodes 11-1 to **11-*n* successively under the control of the controller 23, the column driver 22 outputs individual driving currents according to the image data. The output driving currents are supplied simultaneously to the plurality of column electrodes 12-1 to 12-*m*. The EL elements 13** emit light of their individual colors, combining to display the image data as an image with desired coloration.

Figure 3:
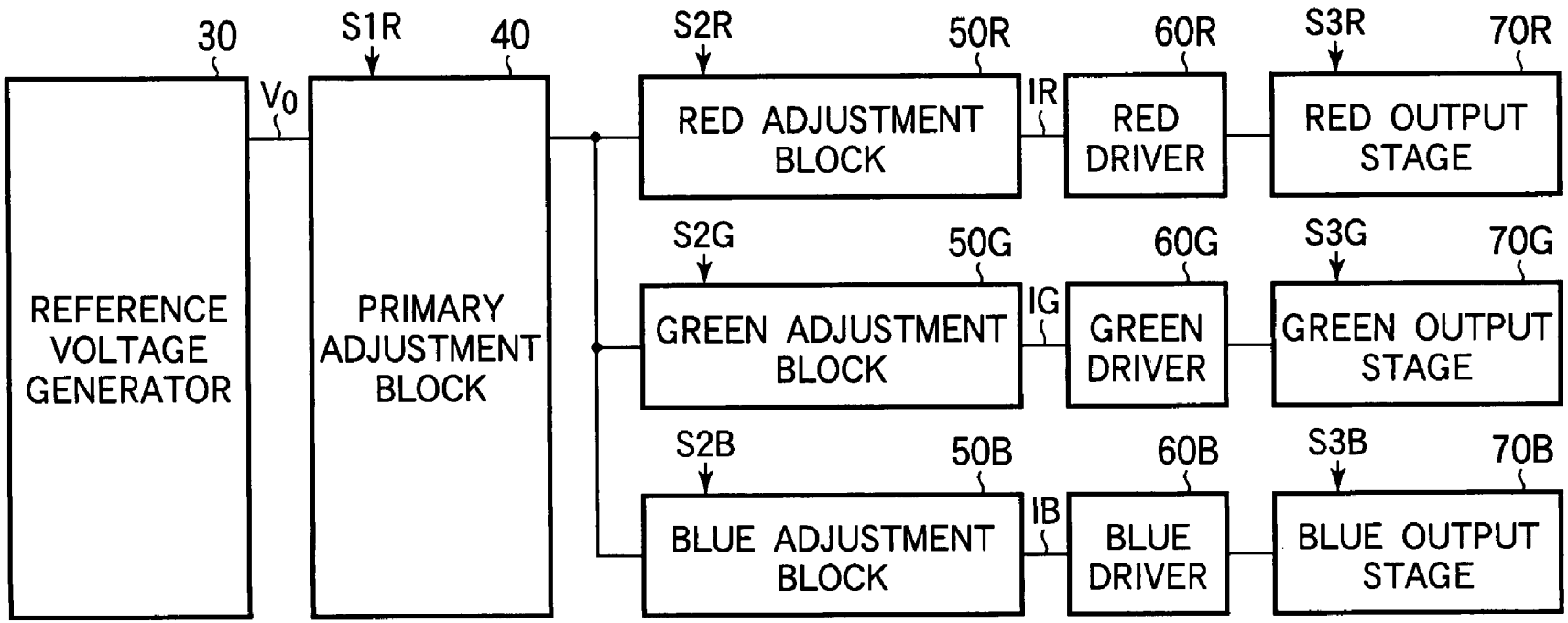
FIG. 3 is a block diagram of a color balancing circuit in a first embodiment of the invention.

FIG. 3 shows the block structure of a color balancing circuit incorporated into the organic EL panel in FIG. 1 in the first embodiment.

The color balancing circuit has a reference voltage generator 30 that generates a DC reference voltage $V_0$. A primary adjustment block 40 is connected to the output stage of the reference voltage generator 30. The primary adjustment block 40 receives the reference voltage $V_0$, varies the received reference voltage $V_0$ according to a brightness adjustment signal S1 having a user-selectable value, and converts the varied reference voltage $V_0$ to a stable primary current I. Red, green, and blue adjustment blocks 50R, 50G, and 50B are connected to the output stage of the primary adjustment block 40.

The primary current I itself may be output to the red, green, and blue adjustment blocks 50R, 50G, and 50B, in which case the primary current should be routed through equal parallel resistances in the red, green, and blue adjustment blocks 50R, 50G, and 50B, so that it is divided into three equal parts. Alternatively, the primary current may be confined to the primary adjustment block 40 and a control voltage that controls the primary current may be output to the red, green, and blue adjustment blocks 50R, 50G, and 50B, as in the second and third embodiments that will be described below.

The red, green, and blue adjustment blocks 50R, 50G, and 50B mirror the primary current I and output red, green, and blue adjusted currents IR, IG, and IB related to the primary current I by ratios selected according to red, green, and blue adjustment signals S2R, S2G, and S2B having user-selectable values. Red, green, and blue drivers 60R, 60G, and 60B are connected to the output stages of the red, green, and blue adjustment blocks 50R, 50G, and 50B, respectively.

The drivers 60R, 60G, and 60B generate red, green, and blue driving currents that mirror the received red, green, and blue adjusted currents IR, IG, and IB. Red, green, and blue output stages 70R, 70G, and 70B are connected to the output stages of the drivers 60R, 60G, and 60B, respectively. The output stages 70R, 70G, and 70B collectively include m output transistors and m switching elements, the switching elements being controlled by control signals S3R, S3G, and S3B. Red, green, and blue driving currents are output from the output transistors to the column electrodes 12-1, 12-2, 12-3, . . . in FIG. 1 during intervals determined by the control signals S3R, S3G, S3B.

The reference voltage generator 30, the primary adjustment block 40, the red, green, and blue adjustment blocks 50R, 50G, and 50B, and the drivers 60R, 60G, and 60B in FIG. 3 may be included in the controller 23 in FIG. 1, the output stages 70R, 70G, and 70B being included in the column driver 22. Alternatively, the drivers 60R, 60G, and 60B may be incorporated into the column driver 22 together with the output stages. In any case, each of the circuit blocks in FIG. 3 is included in some one of the circuit blocks in FIG. 1.

When supplied with the DC reference voltage $V_0$ from the reference voltage generator 30, the primary adjustment block 40 generates a primary current I according to the user-selected value of the brightness adjustment signal S1 and supplies either the primary current or a corresponding control voltage signal to the red, green, and blue adjustment blocks 50R, 50G, and 50B. The red, green, and blue adjustment blocks 50R, 50G, and 50B mirror the primary current I with ratios selected according to the user-selected values of the red, green, and blue adjustment signals S2R, S2G, and S2B and generate red, green, and blue adjusted currents IR, IG, and IB.

The drivers 60R, 60G, and 60B mirror the red, green, and blue adjusted currents IR, IG, and IB to generate red, green, and blue driving currents, which are in turn mirrored in the output stages 70R, 70G, and 70B. When the control signals S3R, S3G, and S3B output from the controller 23 are active, and the mirrored red, green, and blue driving currents are supplied to the column electrodes 12-1, . . . in the panel surface 10 in FIG. 1. The EL elements 13R, 13G, and 13B then emit red, green, and blue light, combining to display an image with desired coloration.

As described above, the primary adjustment block 40 only has to generate a primary current according to the brightness adjustment signal S1 and output this current or a corresponding control voltage signal to the red, green, and blue adjustment blocks 50R, 50G, and 50B. The red, green, and blue adjustment blocks 50R, 50G, and 50B, in turn, only have to mirror the primary current I according to the red, green, and blue adjustment signals S2R, S2G, and S2B to generate the red, green, and blue adjusted currents IR, IG, and IB, which are then mirrored to generate the actual driving currents. Separation of the functions of the primary adjustment block 40 and the functions of the red, green, and blue adjustment blocks 50R, 50G, and 50B from each other, and from the driver and output functions, enables each circuit block to have a minimum size, resulting in a small total size of the color balancing circuitry. More specifically, the first embodiment has the following effects (a) to (c).

(a) The primary current adjustment that controls the brightness of the display and the further independent fine adjustments of the red, green, and blue brightness that determine the color balance can be carried out simultaneously.

(b) The primary current adjustment does not have to be carried out in each of the red, green, and blue adjustment blocks 50R, 50G, and 50B. Circuit size is reduced accordingly.

(c) The color balance among the red, green, and blue EL elements 13R, 13G, and 13B can be adjusted at the factory according to the structure of the panel surface 10, the characteristics of the EL elements 13R, 13G, and 13B, and other factors, leaving only the single primary brightness adjustment to be made in the field. The brightness can then be adjusted without the need to set the red, green, and blue brightnesses individually.

Second Embodiment

The second embodiment is a specific instance of the first embodiment, and has the general configuration shown in FIG. 3.

Figure 4:
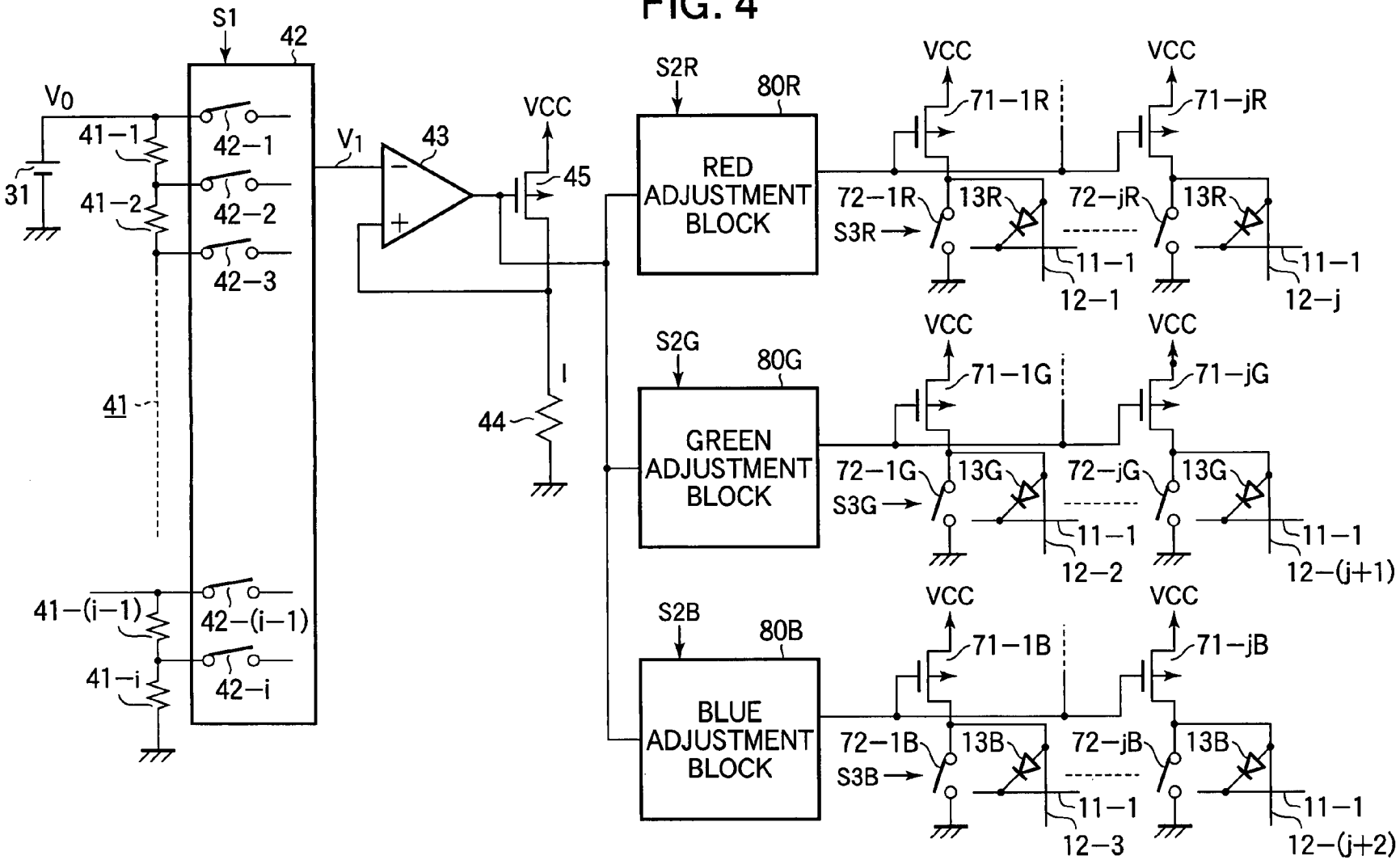
FIG. 4 is a circuit diagram of a color balancing circuit in a second embodiment of the invention.

Referring to FIG. 4, in the second embodiment, the reference voltage generator 30 in FIG. 3 includes a power supply 31 such as a battery that supplies the reference voltage $V_0$ to the primary adjustment block 40. The primary adjustment block 40 includes a voltage divider 41 that divides the reference voltage $V_0$ to obtain a plurality of divided voltages, a selector 42 that selects one desired divided voltage $V_1$ from among the divided voltages according to the brightness adjustment signal S1, and a converter circuit that generates the constant primary current I according to the selected divided voltage $V_1$.

The voltage divider 41 has i resistors 41-1 to **41-*i* that divide the reference voltage $V_0$, where i is a positive integer greater than one. The resistors 41-1 to 41-*i* are connected in series between the power supply 31 and ground, and output i divided voltages to the selector 42. The selector 42 includes i switches 42-1 to 42-*i* that are controlled by the brightness adjustment signal S1, which closes one of the switches 42-1 to 42-*i*** at a time, thereby supplying a selected divided voltage $V_1$ to the converter circuit.

The converter circuit includes an op-amp 43, a resistor 44, and a unit-size p-channel metal-oxide-semiconductor (hereinafter, PMOS) transistor 45, interconnected to regulate the primary current I according to the selected divided voltage $V_1$. Specifically, the op-amp 43 has a non-inverting input terminal connected to receive the selected voltage $V_1$ from the selector 42, and an inverting input terminal connected to one end of the resistor 44 and the drain of PMOS transistor 45. The other end of the resistor 44 is connected to ground. The output terminal of the op-amp 43 is connected to the gate of PMOS transistor 45 and to input terminals of red, green, and blue adjustment blocks 80R, 80G, and 80B. The source of PMOS transistor 45 is connected to a node at the power supply potential VCC. The primary current I flows from the power supply through PMOS transistor 45 and resistor 44 to ground.

The red, green, and blue adjustment blocks 80R, 80G, and 80B have identical circuit configurations that include the red, green, and blue adjustment blocks 50R, 50G, and 50B and the drivers 60R, 60G, and 60B in FIG. 3. The output stages 70R, 70G, and 70B in FIG. 3 are connected to the red, green, and blue adjustment blocks 80R, 80G, and 80B, respectively.

The red output stage 70R in FIG. 3 includes m/3 PMOS transistors 71-1R, 71-4R, 71-7R, . . . , 71-*j*R, (j=m−2) as shown in FIG. 4. These PMOS transistors have their gates connected in parallel to the output stage of the red adjustment block 80R, their sources connected to nodes at the power supply potential VCC, and their drains connected to the red column electrodes 12-1, 12-4, 12-7, . . . , 12-*j* in FIG. 1. These column electrodes 12-1, 12-4, 12-7, . . . , 12-*j* are connected to the row electrodes 11-1, . . . via the red EL elements 13R. The drains of PMOS transistors 71-1R to 71-*j*R are also connected to ground via switching elements 72-1R, 72-4R, 72-7R, . . . , 72-*j*R that are controlled by control signal S3R.

The drains of the PMOS transistors 71-1R to 71-*j*R in FIG. 4 output currents that mirror a driving current generated in the red adjustment block 80R. When the switching elements 72-1R to 72-*j*R are open, these output currents are shunted to ground. When the switching elements 72-1R to 72-*j*R are closed, the output currents are supplied to the red column electrodes 12-1, 12-4, 12-7, . . . , 12-*j*, causing the EL elements 13R to emit red light. Control signal S3R controls the switching elements 72-1R to 72-*j*R individually according to the image data shown at the bottom of FIG. 2, each switching element being opened for a time corresponding to the designated red intensity level of the pixel.

The green output stage 70G in FIG. 3 similarly includes m/3 PMOS transistors 71-1G, 71-4G, . . . , 71-*j*G with gates connected in parallel to the output stage of the green adjustment block 80G, sources connected to nodes at the power supply potential VCC, and drains connected to the green column electrodes 12-2, 12-5, . . . , 12-*j*+1, the drains also being connected to ground via switching elements 72-1G, 72-4G, . . . , 72-*j*G controlled by control signal S3G. When the switching elements 72-1G, 72-4G, . . . , 72-*j*G are opened, the corresponding EL elements 13G emit green light.

The blue output stage 70B in FIG. 3 likewise includes m/3 PMOS transistors 71-1B, 71-4B, . . . , 71-*j*B with gates connected in parallel to the output stage of the blue adjustment block 80B, sources connected to nodes at the power supply potential VCC, and drains connected to the blue column electrodes 12-3, 12-6, . . . , 12-*j*+2, the drains also being connected to ground via switching elements 72-1B, 72-4B, . . . , 72-*j*B controlled by control signal S3B. When the switching elements 72-1B, 72-4B, . . . , 72-*j*B are opened, the corresponding EL elements 13B emit blue light.

Figure 5:
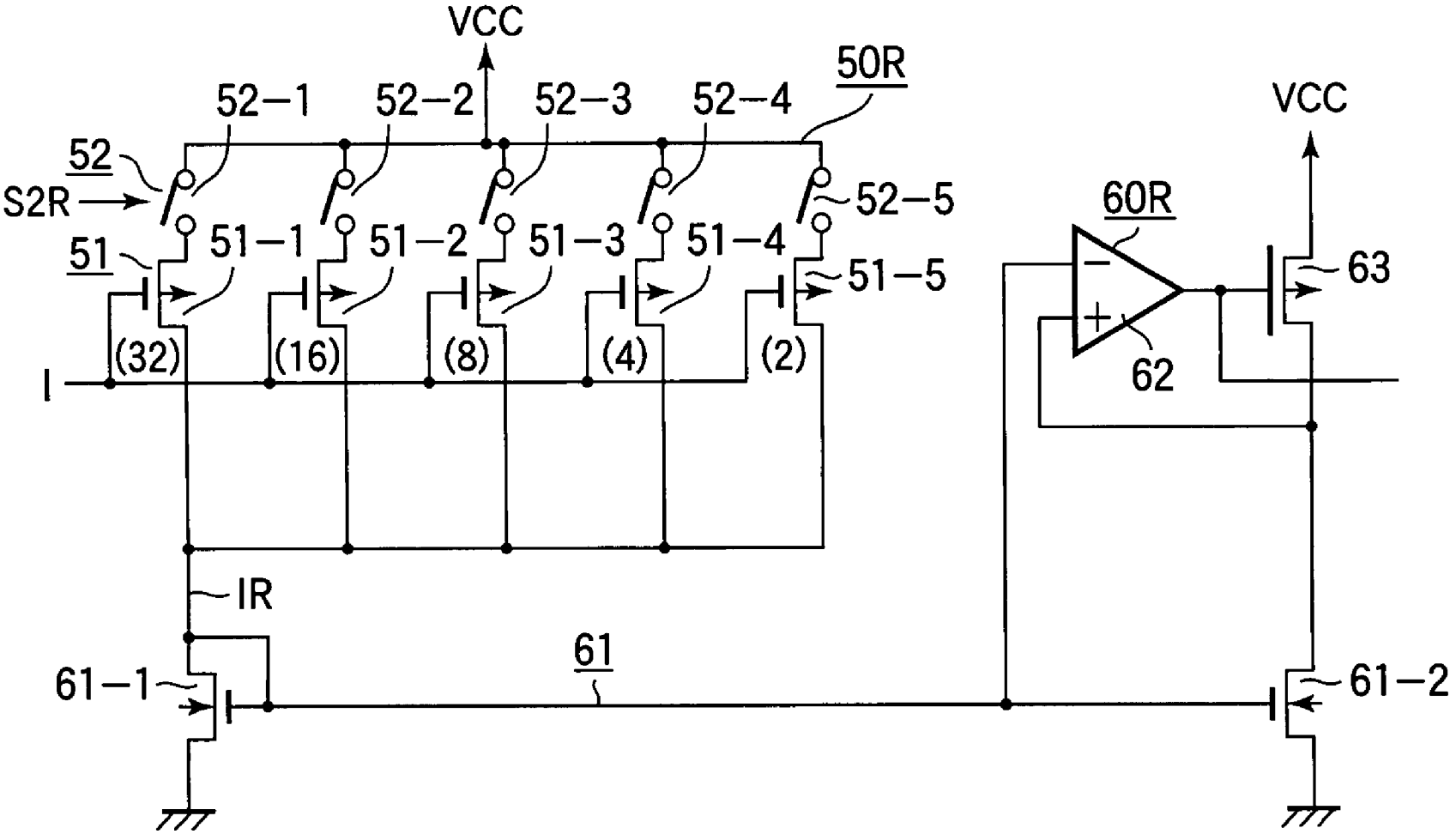
FIG. 5 is a circuit diagram of the red adjustment block in FIG. 4.

FIG. 5 shows the circuit configuration of the red adjustment block 80R in FIG. 4. The circuit configurations of the green and blue adjustment blocks 80G and 80B are identical to the circuit configuration of the red adjustment block 80R. The red adjustment block 80R includes the red adjustment block 50R and the red driver 60R in FIG. 3.

The red adjustment block 50R includes a first current mirror circuit 51 with a plurality of PMOS transistors and a switching circuit 52 with a plurality of switching elements. In the example shown there are five PMOS transistors 51-1 to 51-5, and five switching elements 52-1 to 52-5 controlled by the red adjustment signal S2R to select PMOS transistors 51-1 to 51-5. The transistor sizes (channel widths) of PMOS transistors 51-1 to 51-5 are, for example, 32 times, 16 times, 8 times, 4 times, and 2 times the transistor size (channel width) of PMOS transistor 45 in FIG. 4. The gates of PMOS transistors 51-1 to 51-5 are connected to the output terminal of the op-amp 43 and the gate of PMOS transistor 45 in FIG. 4. (Strictly speaking, the first current mirror circuit 51 also includes PMOS transistor 45 in FIG. 4.)

The drains of PMOS transistors 51-1 to 51-5 are mutually interconnected. Their sources are connected to a node at the power supply potential VCC via the switching elements 52-1 to 52-5. When the red adjustment signal S2R closes at least one of the switching elements 52-1 to 52-5, a red adjusted current IR N times the primary current I (where N is an even number from two to sixty-two) flows from the interconnected drains of PMOS transistors 51-1 to 51-5 to the red driver 60R. If, for example, switching element 52-2 alone is closed, the red adjusted current IR is sixteen times the primary current I, since the size of PMOS transistor 51-2 is sixteen times the size of PMOS transistor 45.

The red driver 60R in FIG. 3 includes a second current mirror circuit 61 with a pair of n-channel metal-oxide-semiconductor (hereinafter, NMOS) transistors 61-1 and 61-2 for mirroring the red adjusted current IR output from the red adjustment block 50R. The red driver 60R also includes an op-amp 62 and a PMOS transistor 63 that control the drain current of NMOS transistor 61-2. The gates of NMOS transistors 61-1 and 61-2 are both connected to the drain of NMOS transistor 61-1, which is connected to the drains of PMOS transistors 51-1 to 51-5. The sources of NMOS transistors 61-1 and 61-2 are connected to ground. The red adjusted current IR accordingly flows between the drain and source of NMOS transistor 61-1, and an identical mirroring current flows between the drain and source of NMOS transistor 61-2.

NMOS transistor 61-2 has its drain connected to the inverting input terminal of the op-amp 62, and its gate connected to the non-inverting input terminal of the op-amp 62. PMOS transistor 63 has a gate connected to the output terminal of the op-amp 62, a source connected to a node at the power supply potential VCC, and a drain connected to the drain of NMOS 61-2. With this connection topology, the op-amp 62 produces a control voltage that makes PMOS transistor 63 feed a current identical to the red adjusted current IR to the drain of NMOS transistor 61-2, so that the gate and drain potentials of NMOS transistor 61-2 are equal.

Next, the operation of the second embodiment will be explained.

The voltage divider 41 divides the DC reference voltage $V_0$ supplied from the power supply 31 to obtain a plurality of divided voltages. The switch (switch 42-2, for example) in the selector 42 in the primary adjustment block 40 that is closed according to the user-selected value of the brightness adjustment signal S1 selects one of the divided voltages, and supplies the selected divided voltage $V_1$ to the op-amp 43. The op-amp 43 outputs a first control voltage to the gate of PMOS transistor 45, causing PMOS transistor 45 to feed a primary current I through resistor 44 such that the drain voltage of PMOS transistor 45 is equal to the selected divided voltage $V_1$. This first control voltage is also output to the red, green, and blue adjustment blocks 80R, 80G, and 80B.

In the red, green, and blue adjustment blocks 80R, 80G, and 80B, the red, green, the primary current I is mirrored according to the red, green, and blue adjustment signals S2R, S2G, and S2B to generate the red, green, and blue adjusted currents IR, IG, and IB, which are then mirrored to generate the driving currents.

In the red adjustment block 80R, for example, the first control voltage is input to the gates of PMOS transistors 51-1 to 51-5. The transistors connected to the switching elements that are closed by the red adjustment signal S2R combine to produce the red adjusted current IR, which flows between the drain and source of NMOS transistor 61-1. An identical current also flows between the drain and source of NMOS transistor 61-2, and the output terminal of the op-amp 62 supplies a second control voltage corresponding to this current to the red output stage 70R. If, for example, switching element 52-3 alone is closed by the red adjustment signal S2R, a second control voltage corresponding to a red adjusted current IR eight times the primary current I is supplied to the red output stage 70R.

The drivers 60R, 60G, and 60B in the red, green, and blue adjustment blocks 80R, 80G, and 80B mirror the red, green, and blue adjusted currents IR, IG, and IB to generate red, green, and blue driving currents, which are in turn mirrored in the output stages 70R, 70G, and 70B. When the control signals S3R, S3G, and S3B are active, the mirrored red, green, and blue driving currents are supplied from the output stages 70R, 70G, and 70B to the selected column electrodes 12-1, . . . . The EL elements 13R, 13G, and 13B then emit red, green, and blue light, combining to display an image with desired coloration.

In the second embodiment, as in the first embodiment, separation of the functions of the selector 42 for the primary brightness adjustment and the functions of the red, green, and blue adjustment blocks 80R, 80G, and 80B from each other, and from the output functions, enables each circuit block to have a minimum size, resulting in a small total size of the color balancing circuitry. A particular effect of the second embodiment is the following effect (d), as compared with output of the primary current I to the red, green, and blue adjustment blocks.

(d) The primary current is routed through a single resistor 44, instead of being routed through parallel resistors in the red, green, and blue adjustment blocks 80R, 80G, and 80B. Current errors due to variations in resistor values are thereby avoided, the brightness adjustment is simplified, and its accuracy is improved.

Third Embodiment

The third embodiment is another specific instance of the first embodiment, and has the general configuration shown in FIG. 3.

Figure 6:
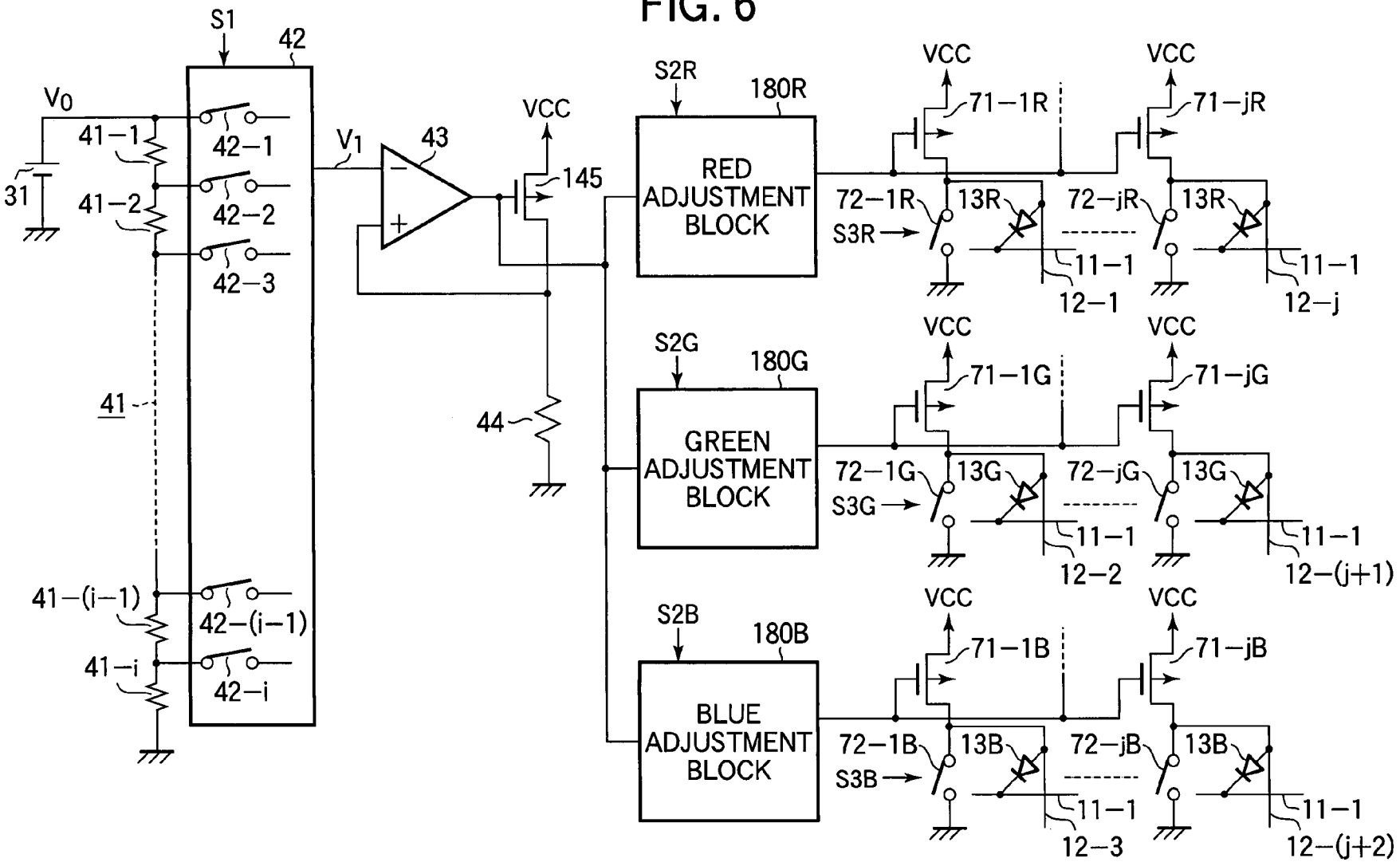
FIG. 6 is a circuit diagram of a color balancing circuit in a third embodiment of the invention.

Referring to FIG. 6, the third embodiment differs from the second embodiment by replacing PMOS transistor 45 in the color balancing circuit in FIG. 4 with a PMOS transistor 145 having different characteristics, and replacing the red, green, and blue adjustment blocks 80R, 80G, and 80B with red, green, and blue adjustment blocks 180R, 180G, and 180B having different circuit configurations. PMOS transistor 145 has a channel width W=a, and a channel length L=b, where the channel size parameters (a and b) have arbitrary values.

Figure 7:
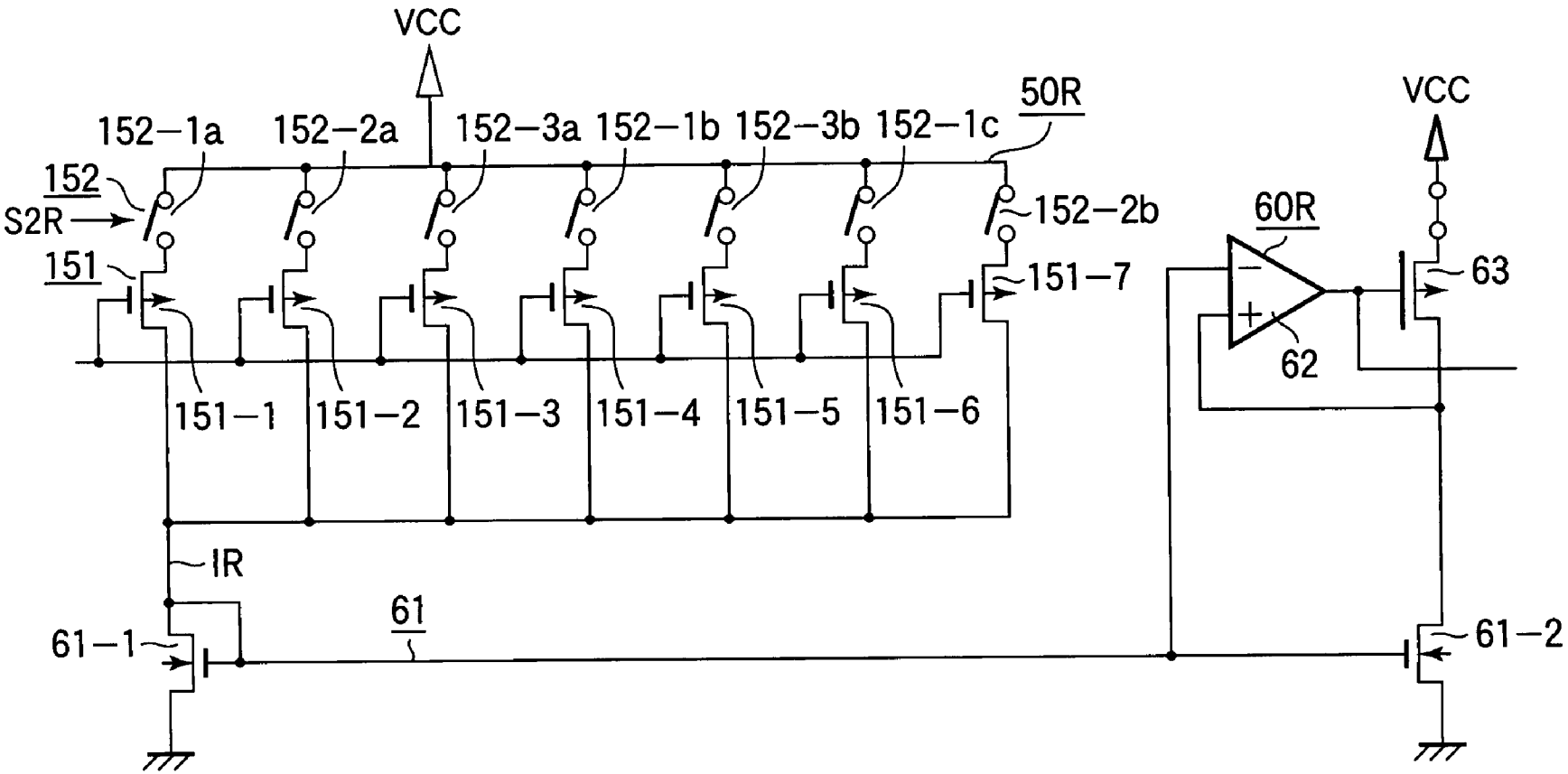
FIG. 7 is a circuit diagram of the red adjustment block in FIG. 6.

FIG. 7 shows the circuit configuration of the red adjustment block 180R in FIG. 6. The circuit configurations of the green and blue adjustment blocks 180G and 180B are identical to the circuit configuration of the red adjustment block 180R. The red adjustment block 180R differs from the red adjustment block 80R in the second embodiment by including a different first current mirror 151 and a different switching circuit 152, instead of the first current mirror circuit 51 and switching circuit 52 in FIG. 5.

The first current mirror 151 in FIG. 7 includes a plurality of PMOS transistors. In the example shown there are seven PMOS transistors 151-1 to 151-7. PMOS transistors 151-1 to 151-7 are identical in size (channel width W=a, channel length L=b) to PMOS transistor 145 in the primary adjustment block 40. The gates of PMOS transistors 151-1 to 151-7 are connected to the output terminal of the op-amp 43 and the gate of PMOS transistor 145 in FIG. 6. The drains of PMOS transistors 151-1 to 151-7 are mutually interconnected. PMOS transistors 151-1 to 151-7 are laid out in a row, and disposed symmetrically about a center of the row.

The sources of PMOS transistors 151-1 to 151-7 are connected to a node at the power supply potential VCC via the switching circuit in FIG. 7. The switching circuit 152 includes a plurality of switching elements. In the example shown there are seven switching elements 152-1*a*, 152-2*a*, 152-3*a*, 152-1*b*, 152-3*b*, 152-1*c*, and 152-2*b* controlled by the red adjustment signal S2R to select PMOS transistors 151-1 to 151-7. Switching elements 152-1*a*, 152-1*b*, and 152-1*c* are closed simultaneously; switching elements 152-2*a* and 152-2*b* are closed simultaneously; and switching elements 152-3*a* and 152-3*b* are closed simultaneously. The switching elements 152-1*a*, 152-1*b*, and 152-1*c* are connected to the sources of PMOS transistors 151-1, 151-4, and 151-6; switching elements 152-2*a* and 152-2*b* are connected to the sources of PMOS transistors 151-2 and 151-7; switching elements 152-3*a* and 152-3*b* are connected to the sources of PMOS transistors 151-3 and 151-5.

If, for example, the switching elements 152-1*a*, 152-1*b*, and 152-1*c* are closed simultaneously by the red adjustment signal S2R, currents from the power supply flow between the sources and drains of the PMOS transistors 151-1, 151-4, and 151-7 connected to the switching elements 152-1*a*, 152-1*b*, and 152-1*c*. PMOS transistors 151-1, 151-4, and 151-7 combine to feed a red adjusted current IR equal to three times the primary current I to the drain of transistor 61-1 in the second current mirror circuit 61. Other combinations of switching elements can be turned on to obtain a red adjustment current equal to two, four, five, or seven times the primary current I.

The third embodiment operates basically like the second embodiment except that the operation of the first current mirror 151 and the switching circuit 152 in the third embodiment in FIG. 7 differs from the operation of the first current mirror circuit 51 and the switching circuit 52 in the second embodiment.

In addition to the effects (a) to (d) in the second embodiment, the third embodiment has the effect of a simplified manufacturing process, because the first current mirror 151 in FIG. 7 includes PMOS transistors 151-1 to 151-7 of equal size.

VARIATIONS

The invention is not limited to the preceding embodiments. For example, the transistors used in the circuit configurations in FIGS. 4 to 7 showing specific configurations of the reference voltage generator 30, the primary adjustment block 40, the red, green, and blue adjustment blocks 50R, 50G, and 50B, the drivers 60R, 60G, and 60B, and the output stages 70R, 70G, and 70B are not limited to the transistors described above. The PMOS transistors may be replaced with NMOS transistors, the NMOS transistors may be replaced with PMOS transistors, or both types of MOS transistors may be replaced with other types of transistors such as bipolar transistors.

The invention is not limited to use in an organic EL panel, but can also be used in the color balancing circuits of other types of flat color display panels.

The output stages may be configured to display different pixel intensities by supplying different amounts of current instead of supplying current for different durations of time. For example, if the pixel data include a plurality of bits for each primary color, a like plurality of output transistors of different sizes may be connected to each column electrode.

Those skilled in the art will recognize that further variations are possible within the scope of the invention, which is defined in the appended claims.

What is claimed is:

1. A color balancing circuit for a display panel having a panel surface on which a plurality of picture elements, each including a red light-emitting element, a green light-emitting element, and a blue light-emitting element, are arranged in a matrix, the color balancing circuit including:

a reference voltage generator for generating a reference voltage;

a primary adjustment block for varying the reference voltage according to a brightness adjustment signal having a user-selectable value designating a single primary brightness for the red, green, and blue light-emitting elements alike, and converting the varied reference voltage to a primary current, the primary adjustment block comprising a voltage divider for dividing the reference voltage to obtain a plurality of divided voltages, and a selector for selecting one of the divided voltages according to the brightness adjustment signal;

a red adjustment block connected to the primary adjustment block for generating a red adjusted current related to the primary current by a ratio selected according to a red adjustment signal having another user-selectable value;

a green adjustment block connected to the primary adjustment for generating a green adjusted current related to the primary current by a ratio selected according to a green adjustment signal having yet another user-selectable value;

a blue adjustment block connected to the primary adjustment for generating a blue adjusted current related to the primary current by a ratio selected according to a blue adjustment signal having still another user-selectable value;

three drivers for generating red, green, and blue driving currents from the red, green, and blue adjusted currents, respectively; and three output stages for generating output currents from the red, green, and blue driving currents and supplying the output currents to the red, green, and blue light-emitting elements, causing the red, green, and blue light-emitting elements to emit light;

wherein each of the red, green, and blue adjustment blocks separately comprises;

a first current mirror circuit with a plurality of transistors connected in parallel to mirror the primary current in the converter circuit; and a plurality of switches connected in series with respective ones of said plurality of transistors, the switches being controlled by the red adjustment signal to generate the red adjusted current in the red adjustment block, by the green adjustment signal to generate the green adjusted current in the green adjustment block, and by the blue adjustment signal to generate the blue adjusted current in the blue adjustment block;

wherein said plurality of transistors have mutually identical dimensions; and wherein said plurality of transistors are laid out in a row and said switches are controlled to feed current through a selectable subset of said plurality of transistors disposed symmetrically about a center of said row.

2. A color balancing circuit for a display panel having a panel surface on which a plurality of picture elements, each including a red light-emitting element, a green light-emitting element, and a blue light-emitting element, are arranged in a matrix the color balancing circuit including:

a reference voltage generator for generating a reference voltage;

a primary adjustment block for varying the reference voltage according to a brightness adjustment signal having a user-selectable value designating a single primary brightness for the red, green, and blue light-emitting elements alike, and converting the varied reference voltage to a primary current, the primary adjustment block comprising a voltage divider for dividing the reference voltage to obtain a plurality of divided voltages, and a selector for selecting one of the divided voltages according to the brightness adjustment signal;

a red adjustment block connected to the primary adjustment block for generating a red adjusted current related to the primary current by a ratio selected according to a red adjustment signal having another user-selectable value;

a green adjustment block connected to the primary adjustment for generating a green adjusted current related to the primary current by a ratio selected according to a green adjustment signal having yet another user-selectable value;

a blue adjustment block connected to the primary adjustment for generating a blue adjusted current related to the primary current by a ratio selected according to a blue adjustment signal having still another user-selectable value;

three drivers for generating red, green, and blue driving currents from the red, green, and blue adjusted currents, respectively; and three output stages for generating output currents from the red, green, and blue driving currents and supplying the output currents to the red, green, and blue light-emitting elements, causing the red, green, and blue light-emitting elements to emit light;

wherein each of the red, green, and blue adjustment blocks separately comprises:

a first current mirror circuit with a plurality of transistors connected in parallel to mirror the primary current in the converter circuit; and a plurality of switches connected in series with respective ones of said plurality of transistors, the switches being controlled by the red adjustment signal to generate the red adjusted current in the red adjustment block, by the green adjustment signal to generate the green adjusted current in the green adjustment block, and by the blue adjustment signal to generate the blue adjusted current in the blue adjustment block;

wherein each of the three drivers includes a second current mirror circuit for generating the red, green, or blue driving current by mirroring the red, green, or blue adjusted current; and wherein each of the three drivers also includes an operational amplifier having an output terminal, an inverting input terminal, and a non-inverting input terminal.

3. The color balancing circuit of claim 2, wherein the primary adjustment block further comprises a converter circuit having an operational amplifier, a transistor, and a resistor connected to regulate the primary current according to the selected divided voltage.

4. The color balancing circuit of claim 3, wherein the operational amplifier has an output terminal, an inverting input terminal, and a non-inverting input terminal, the non-inverting input terminal being connected to the selector, said transistor has a control terminal connected to the output terminal of the operational amplifier, and said transistor has a current output terminal connected to said resistor and the inverting input terminal of the operational amplifier.

5. The color balancing circuit of claim 2, wherein said plurality of transistors have commonly interconnected current output terminals.

6. The color balancing circuit of claim 2, wherein said plurality of transistors have respective control terminals connected in common to the primary adjustment block.

7. The color balancing circuit of claim 2, wherein said plurality of transistors have mutually differing dimensions.

8. The color balancing circuit of claim 7, wherein said plurality of transistors are sized according to successive powers of two.

9. The color balancing circuit of claim 2, wherein said plurality of transistors have mutually identical dimensions.

10. The color balancing circuit of claim 2, wherein the second current mirror circuit comprises: a first transistor having a first current input terminal receiving the red, green, or blue adjusted current, and a first control terminal connected to the first current input terminal and the non-inverting input terminal of the operational amplifier; a second transistor having a second current input terminal connected to the inverting input terminal of the operational amplifier, and a second control terminal connected to the first control terminal of the first transistor; and a third transistor having a current output terminal connected to the current input terminal of the second transistor, and a control terminal connected to the output terminal of the operational amplifier.

11. The color balancing circuit of claim 2, wherein the light-emitting elements are electroluminescence elements.

12. The color balancing circuit of claim 11, wherein the light-emitting elements are organic electroluminescence elements.

13. A color balancing circuit for a display panel having a panel surface on which a plurality of picture elements, each including a red light-emitting element, a green light-emitting element, and a blue light-emitting element, are arranged in a matrix, the color balancing circuit including:

a reference voltage generator for generating a reference voltage;

a primary adjustment block for varying the reference voltage according to a brightness adjustment signal having a user-selectable value designating a single primary brightness for the red, green, and blue light-emitting elements alike, and converting the varied reference voltage to a primary current, the primary adjustment block comprising a voltage divider for dividing the reference voltage to obtain a plurality of divided voltages, and a selector for selecting one of the divided voltages according to the brightness adjustment signal;

a red adjustment block connected to the primary adjustment block for generating a red adjusted current related to the primary current by a ratio selected according to a red adjustment signal having another user-selectable value;

a green adjustment block connected to the primary adjustment for generating a green adjusted current related to the primary current by a ratio selected according to a green adjustment signal having yet another user-selectable value;

a blue adjustment block connected to the primary adjustment for generating a blue adjusted current related to the primary current by a ratio selected according to a blue adjustment signal having still another user-selectable value;

three drivers for generating red, green, and blue driving currents from the red, green, and blue adjusted currents, respectively; and three output stages for generating output currents from the red, green, and blue driving currents and supplying the output currents to the red, green, and blue light-emitting elements, causing the red, green, and blue light-emitting elements to emit light;

wherein each of the red, green, and blue adjustment blocks separately comprises:

a first current mirror circuit with a plurality of transistors connected in parallel to mirror the primary current in the converter circuit; and a plurality of switches connected in series with respective ones of said plurality of transistors, the switches being controlled by the red adjustment signal to generate the red adjusted current in the red adjustment block, by the green adjustment signal to generate the green adjusted current in the green adjustment block, and by the blue adjustment signal to generate the blue adjusted current in the blue adjustment block;

wherein each of the three drivers includes a second current mirror circuit for generating the red, green, or blue driving current by mirroring the red, green, or blue adjusted current; and wherein each of the three output stages includes a third current mirror circuit having a plurality of transistors connected in parallel to mirror the red, green, or blue driving current.

14. The color balancing circuit of claim 13, wherein the primary adjustment block further comprises a converter circuit having an operational amplifier, a transistor, and a resistor connected to regulate the primary current according to the selected divided voltage.

15. The color balancing circuit of claim 14, wherein the operational amplifier has an output terminal, an inverting input terminal, and a non-inverting input terminal, the non-inverting input terminal being connected to the selector, said transistor has a control terminal connected to the output terminal of the operational amplifier, and said transistor has a current output terminal connected to said resistor and the inverting input terminal of the operational amplifier.

16. The color balancing circuit of claim 13, wherein said plurality of transistors have commonly interconnected current output terminals.

17. The color balancing circuit of claim 13, wherein said plurality of transistors have respective control terminals connected in common to the primary adjustment block.

18. The color balancing circuit of claim 13, wherein said plurality of transistors have mutually differing dimensions.

19. The color balancing circuit of claim 18, wherein said plurality of transistors are sized according to successive powers of two.

20. The color balancing circuit of claim 13, wherein said plurality of transistors have mutually identical dimensions.

* * * * *